US007360736B2

(12) United States Patent
Zangirolami

(10) Patent No.: US 7,360,736 B2
(45) Date of Patent: Apr. 22, 2008

(54) VISCOUS BRAKING DEVICE EQUIPPED WITH MONODIRECTIONAL MECHANISM, PARTICULARLY FOR MOSQUITO CURTAINS

(75) Inventor: Marco Zangirolami, Borgoticino (IT)

(73) Assignee: Gianus S.p.A., Milan (IT)

( * ) Notice: Subject to any disclaimer, the term of this patent is extended or adjusted under 35 U.S.C. 154(b) by 342 days.

(21) Appl. No.: 10/892,036

(22) Filed: Jul. 14, 2004

(65) Prior Publication Data

US 2005/0000760 A1 Jan. 6, 2005

Related U.S. Application Data

(63) Continuation-in-part of application No. PCT/IT02/00403, filed on Jun. 20, 2002.

(30) Foreign Application Priority Data

Jan. 14, 2002 (IT) ..... TO2002A0038

(51) Int. Cl.
*B65H 23/06* (2006.01)

(52) U.S. Cl. ..... 242/422.2; 160/296

(58) Field of Classification Search ..... 242/396.6, 242/422.4, 396, 381, 422.9, 385.1, 422, 422.2, 242/382.5, 385.3, 396.4; 160/305, 291, 299, 160/298, 296; 188/308, 290, 291, 281, 292, 188/296; 254/377; 182/238; 192/46, 43.2, 192/223.1; 403/97; 16/197, 198
See application file for complete search history.

(56) References Cited

U.S. PATENT DOCUMENTS 2,530,773 A * 11/1950 Johnson et al. ..... 191/12.4
3,543,885 A * 12/1970 Ditlow ..... 188/296
4,286,757 A * 9/1981 Wirth ..... 242/421.1
4,535,829 A * 8/1985 Fukuchi ..... 160/291
5,600,870 A * 2/1997 Fields et al. ..... 16/342
5,794,878 A * 8/1998 Carpenter et al. ..... 242/381
6,059,008 A 5/2000 Yoshida et al. ..... 160/296
6,158,684 A * 12/2000 Hedlund ..... 242/381

(Continued)

FOREIGN PATENT DOCUMENTS

DE 43 20 393 A1 12/1994

OTHER PUBLICATIONS

Patent Abstracts of Japan, "Chain Tranmission Type Lifting Device With Braking Means Against Dropping of Load," vol. 2000, No. 10, Nov. 17, 2000.

*Primary Examiner*—Peter M. Cuomo
*Assistant Examiner*—William E Dondero
(74) *Attorney, Agent, or Firm*—David A. Farah; Sheldon Mak Rose & Anderson PC

(57) ABSTRACT

A monodirectional braking mechanism for use with a device for extending and retracting a sheet of material on a roller, the braking mechanism comprising one or more than one housing, one or more than one rotor within the housing, a brake controller connected to the rotor, and an eccentric brake operatively coupled with the brake controller, where the braking mechanism reduces the force or rate, or both the force and rate, of rotation of the roller as the roller is rotated in a second rotation direction but has substantially no effect on the force or rate of rotation of the roller when the roller is rotated in a first rotation direction, and where the first rotation direction is the reverse of the second rotation direction.

16 Claims, 4 Drawing Sheets

U.S. PATENT DOCUMENTS 6,173,822 B1 * 1/2001 Korb et al. ..... 188/307
6,234,417 B1 * 5/2001 Sauder et al. ..... 242/381
6,591,890 B1 * 7/2003 Grubb et al. ..... 160/296
6,666,252 B2 * 12/2003 Welfonder ..... 160/296
6,799,738 B2 * 10/2004 Sauder et al. ..... 242/381
6,854,505 B2 * 2/2005 Grubb et al. ..... 160/296
2002/0113158 A1 * 8/2002 Arisaka et al. ..... 242/385.1

* cited by examiner

VISCOUS BRAKING DEVICE EQUIPPED WITH MONODIRECTIONAL MECHANISM, PARTICULARLY FOR MOSQUITO CURTAINS

CROSS-REFERENCE TO RELATED APPLICATION

This application is a continuation-in-part of International Patent Application PCT/IT02/00403 entitled "Viscous Braking Device Equipped with Monodirectional Mechanism, Particularly for Mosquito Curtains," filed Jun. 20, 2002, which claims priority from Italian Patent Application TO2002A000038 entitled "Dispositivo di frenatura viscosa dotato di meccanismo monosenso, in particolare per zanzariere," filed Jan. 14, 2002, the contents of which are incorporated by reference herein in their entirety.

BACKGROUND

There exist many devices for extending and retracting a sheet of cloth or other material on a roller. These devices include window shades and rollers for screening fabric, such as mosquito netting. In general, these devices comprise a hollow roller having a winding spring connected to one side. The material is wound around the roller to take up the smallest possible space when the device is in the retracted position. In the extended position, the material is unwound from the roller, and the winding spring is under high tension. When the device is to be returned to the retracted position, tension on the winding spring is released causing the roller to rotate and the material to wind around the roller. Disadvantageously, however, the high load on the winding spring can cause the roller to rotate so fast during retraction that the device can cause injury to the operator, and can also cause loud unpleasant noises.

Therefore, there is a need for a device for extending and retracting a sheet of material on a roller that is not associated with this disadvantage. Further, there is a need for a method of extending and retracting a sheet of cloth or other material on a roller that is not associated with this disadvantage.

SUMMARY

According to one embodiment of the present invention, there is provided a monodirectional braking mechanism for use with a device for extending and retracting a sheet of material on a roller. The braking mechanism comprises one or more than one housing, one or more than one rotor within the housing, a brake controller connected to the rotor, and an eccentric brake operatively coupled with the brake controller. The braking mechanism reduces the force or rate, or both the force and rate, of rotation of the roller as the roller is rotated in a second rotation direction but has substantially no effect on the force or rate of rotation of the roller when the roller is rotated in a first rotation direction, where the first rotation direction is the reverse of the second rotation direction.

In one embodiment, the braking mechanism further comprises one or more than one viscous fluid within the housing. In another embodiment, the viscous fluid comprises one or more than one high-viscosity oil. In another embodiment, the viscous fluid comprises one or more than one grease.

In one embodiment, the rotor comprises a plurality of wings. In another embodiment, the brake controller comprises a cylindrical member having two spiral-shaped external surfaces. In another embodiment, the eccentric brake comprises two or more than two jaws.

In another embodiment, the braking mechanism further comprises one or more than one holder for viscous fluid within the housing. In a preferred embodiment, the holder comprises two or more than two gaskets. In one embodiment, the braking mechanism further comprises a rate multiplier connected to the rotor.

According to another embodiment of the present invention, there is provided a device for extending and retracting a sheet of material. The device comprises a roller and a braking mechanism according to the present invention. In a preferred embodiment, the braking mechanism has a resisting force that is inversely proportional to the rotational rate of the roller as the roller is rotated in the second direction but not when the roller is rotated in the first direction, where the first direction is the reverse of the second direction.

In one embodiment, the device further comprises a system for holding the braking mechanism to a surface or object. In another embodiment, the braking mechanism further comprises one or more than one drum adapted to be coupled to the system. In one embodiment, the housing further comprises one or more than one clamp connecting the roller to the braking mechanism, where the clamp prevents rotation between the roller and braking mechanism. In a preferred embodiment, the device further comprises a sheet of material attached to the roller.

According to another embodiment of the present invention, there is provided a method of extending and retracting a sheet of material on a roller. The method comprises first providing a device according to the present invention, where the device further comprises a sheet of material wound around the roller, causing the roller of the device to rotate in a first rotation direction to extend the material attached to the roller, and then, causing the roller of the device to rotate in a second rotation direction to retract the material attached to the roller. The rotation of the roller in the second rotation direction actuates the braking mechanism in the device reducing the rate of rotation of the roller, the force of rotation of the roller, or both the rate and force of rotation of the roller, as the roller rotates in the second direction. The first rotation direction is the reverse of the second rotation direction.

FIGURES

These and other features, aspects and advantages of the present invention will become better understood with regard to the following description, appended claims, and accompanying figures where:

DESCRIPTION

Figure 1:
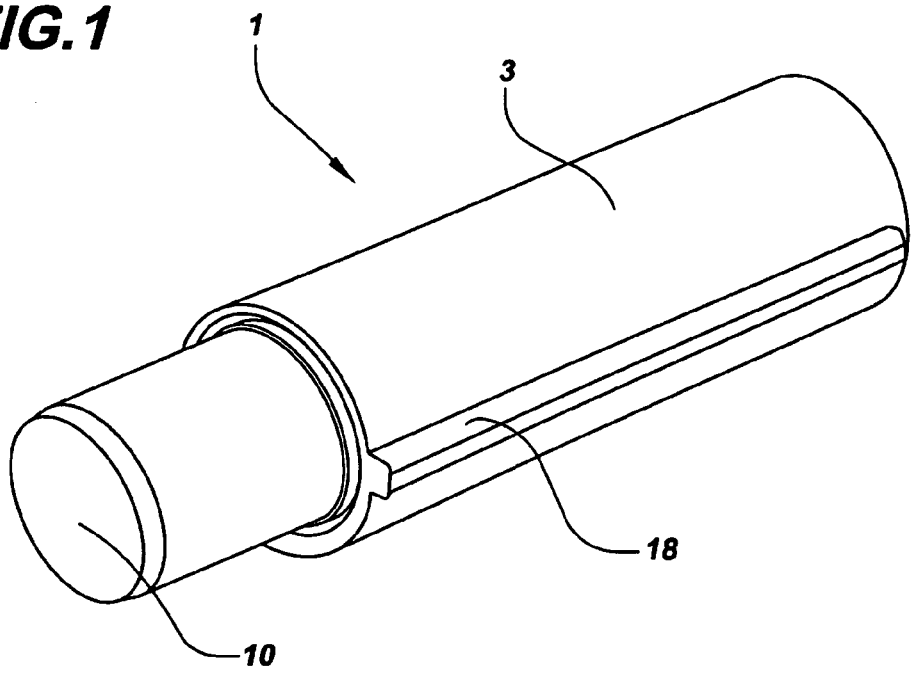
FIG. 1 is a side perspective view of one embodiment of a braking mechanism according to the present invention.
Figure 2:
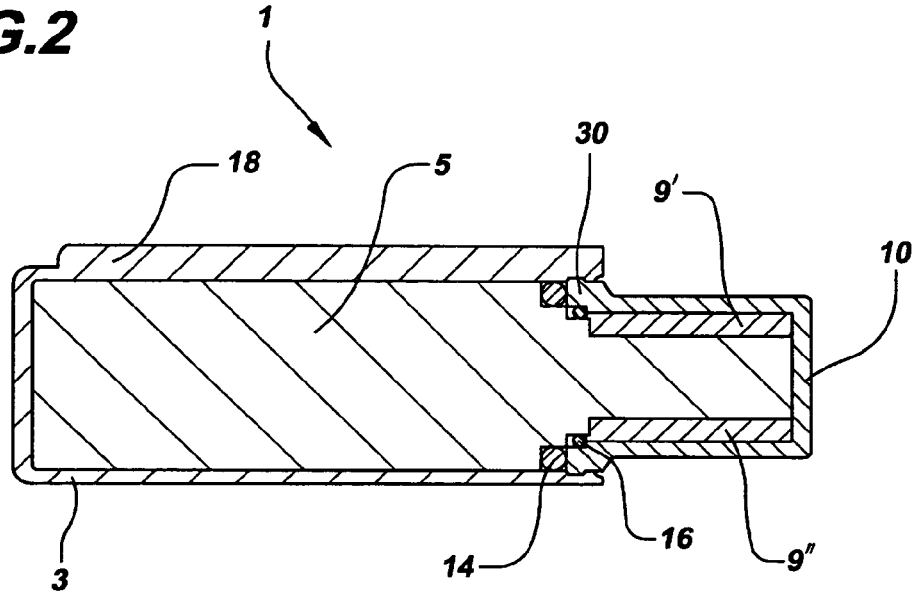
FIG. 2 is a side, cross-sectional view of the braking mechanism shown in FIG. 1.
Figure 3:
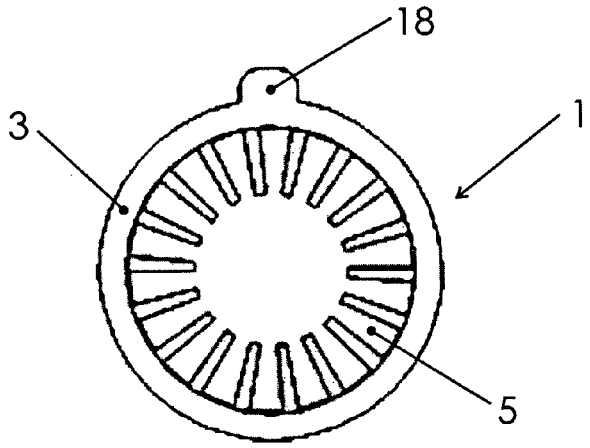
FIG. 3 is an end, cross-sectional view of part of the braking mechanism shown in FIG. 1.
Figure 4:
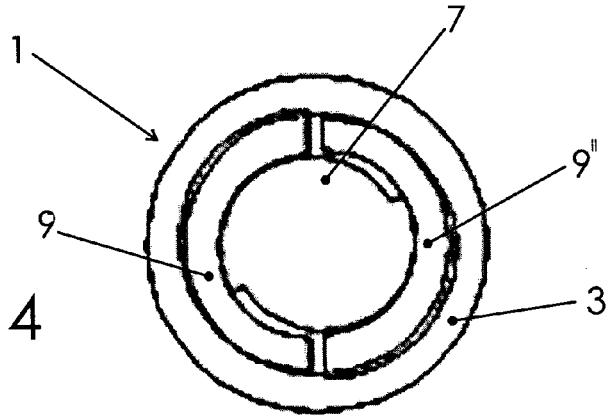
FIG. 4 is an end, cross-sectional view of another part of the braking mechanism shown in FIG. 1.

According to one embodiment of the present invention, there is provided a braking mechanism designed to reduce the force and rate of rotation of a roller suitable for use with a device for extending and retracting a sheet of material on the roller. According to another embodiment of the present invention, there is provided a device for extending and retracting a sheet of material on a roller. In a preferred embodiment, the device comprises a roller and further comprises a braking mechanism designed to reduce the force and rate of rotation of the roller when the sheet of material is retracted around the roller as compared with conventional devices for extending and retracting a sheet of material on a roller. In a preferred embodiment, the device comprises a braking mechanism according to the present invention. According to another embodiment of the present invention, there is provided a method of extending and retracting a sheet of material on a roller where the force and rate of rotation of the roller are reduced when the sheet of material is retracted around the roller. In a preferred embodiment, the method comprises providing a device according to the present invention. The braking mechanism, device and method will now be disclosed in greater detail.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by its intended use.

In one embodiment, the present invention is a braking mechanism suitable for use with a device for extending and retracting a sheet of material on a roller. The braking mechanism is designed to reduce the force and rate of rotation of the roller when the sheet of material is retracted around the roller as compared with the force and rate of rotation of a conventional device for extending and retracting a sheet of material on a roller. The braking mechanism of the present invention is designed for ease of construction in order to reduce manufacturing costs, and is also designed so that, when incorporated in a device for extending and retracting a sheet of material on a roller, the device looks generally like a conventional device for extending and retracting a sheet of material on a roller, and the device can be installed in much the same way as a conventional device in order to be acceptable to an end user as a replacement for a conventional device. In a preferred embodiment, these objectives are accomplished by incorporating the braking mechanism substantially within the roller. Further, the braking mechanism has a resisting force that is inversely proportional to the rotational rate of the roller to increase efficiency when the spring is under high tension, that is when the device is in the maximally extended position, while not preventing the roller from rotating when the material is nearly completely retracted onto the roller.

In a preferred embodiment, the braking mechanism of the present invention comprises one or more than one viscous fluid. A viscous fluid is one that resists internal flow by releasing counteracting forces, such as oil. In another preferred embodiment, the braking mechanism is monodirectional. In a particularly preferred embodiment, the braking mechanism of the present invention both comprises a viscous fluid and is monodirectional.

In another embodiment, the present invention is a rotating device comprising the braking mechanism of the present invention. In a preferred embodiment, the device comprises a roller and further comprises the braking mechanism of the present invention. In a particularly preferred embodiment, the device is a retractable window shade. In another particularly preferred embodiment, the device is a roller for mosquito netting.

Figure 9:
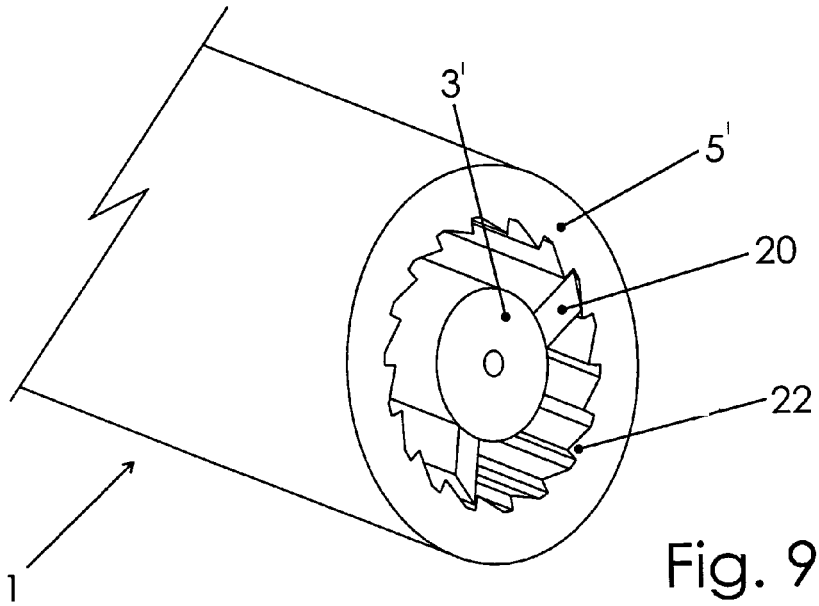
FIG. 9 is a partial schematic perspective, cross-sectional view of a ratchet gear variation of the braking mechanism of the present invention.

Referring now to the FIG. 1 to FIG. 9, there are shown, respectively, a side perspective view of one embodiment of a braking mechanism according to the present invention (FIG. 1); a side, cross-sectional view of the braking mechanism shown in FIG. 1 (FIG. 2); an end, cross-sectional view of part of the braking mechanism shown in FIG. 1 (FIG. 3); an end, cross-sectional view of another part of the braking mechanism shown in FIG. 1 (FIG. 4); is an exploded, side perspective view (upper) of the braking mechanism shown in FIG. 1 about to be inserted into one end of a roller, and a side perspective, partial cutaway view of a device according to one embodiment of the present invention (lower) comprising a braking mechanism as shown in FIG. 1 (FIG. 5); a close-up, exploded, side perspective view of the braking mechanism shown in FIG. 1 (FIG. 6); a partial side perspective view of the device shown in FIG. 1 that shows the jaws in their extended position (FIG. 7); a partial side perspective view of the device shown in FIG. 1 that shows the jaws in their retracted position (FIG. 8); and a partial schematic perspective, cross-sectional view of a ratchet gear variation of the braking mechanism of the present invention (FIG. 9). As can be seen particularly in FIGS. 1, 2 and 5, in one embodiment, the present invention is a braking mechanism 1. The braking mechanism 1 is preferably monodirectional, that is, that the braking mechanism reduces the force or rate, or both the force and rate, of rotation of the roller when the sheet of material is retracted around the roller as compared with conventional devices for extending and retracting a sheet of material on a roller, but where the braking mechanism has substantially no effect on the force or rate of rotation of the roller when the sheet of material is extended from the roller. As can further be seen particularly in FIG. 5, the present invention is also a device comprising a roller 2 and further comprising a braking mechanism 1 designed to reduce the force and rate of rotation of the roller when a sheet of material attached to the roller (not shown) is retracted around the roller 2.

In one embodiment, the braking mechanism 1 comprises one or more than one housing 3, one or more than one rotor 5 within the housing 3, an eccentric brake controller 7 connected to the rotor 5, and an eccentric brake 9 operatively coupled with the eccentric brake controller 7. The housing 3 (corresponding to a stator in a motor) contains a viscous fluid and substantially surrounds all of the main components of the braking mechanism 1. The housing 3 is configured for easy assembly.

The rotor 5 comprises a plurality of wings that increase turbulence in the viscous fluid and also provide storage room for the viscous fluid. In a preferred embodiment, the eccentric brake controller 7 and the eccentric brake 9 allow a substantially unhindered rotation of the roller in a first rotation direction of the rotor 5, but act to reduce the force and rate of rotation of a roller connected to the braking mechanism 1 when the roller rotates in a second rotation direction of the rotor 5, where the second rotation direction is the reverse of the first rotation direction.

As can be seen particularly in FIGS. 1, 2, 5 and 6, in a preferred embodiment, the braking mechanism 1 further comprises one or more than one drum 10 adapted to be coupled with an external system 11 for holding the braking mechanism 1 to a surface or object. In use, the braking mechanism 1 is placed inside a roller, and the drum 10 of the braking mechanism 1 is engaged with the external holding system 11. The drum 10 surrounds the eccentric brake controller 7 and the eccentric brake 9. The drum 10 has a sufficient mechanical resistance externally to be stiffly keyed onto an elastic joint integral with the fixed part of a supporting frame. In one embodiment, the elastic joint comprises a helical spring section with winding direction opposite to the brake locking direction, so that, when the helical spring section is stressed, it tends to tightly wind the drum itself, blocking it. One end of the drum 10 comprises a profile 30 adapted to be inserted into a housing undercut and to allow a snap-type connection to the braking mechanism 1.

Figure 7:
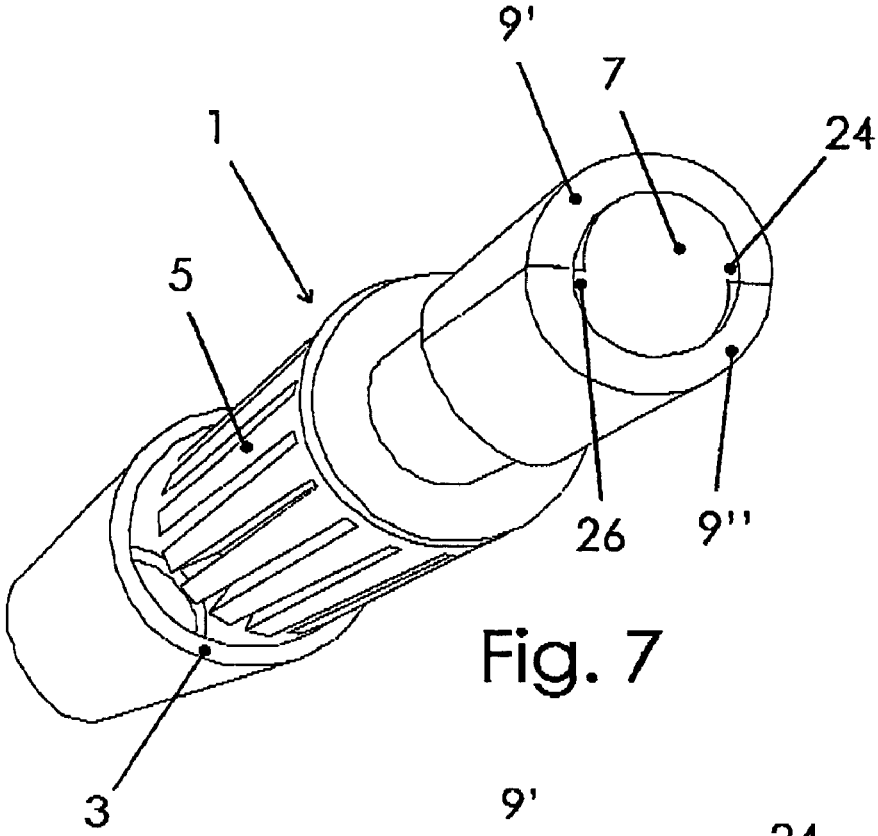
FIG. 7 is a partial side perspective view of the device shown in FIG. 1 that shows the jaws in their extended position.
Figure 8:
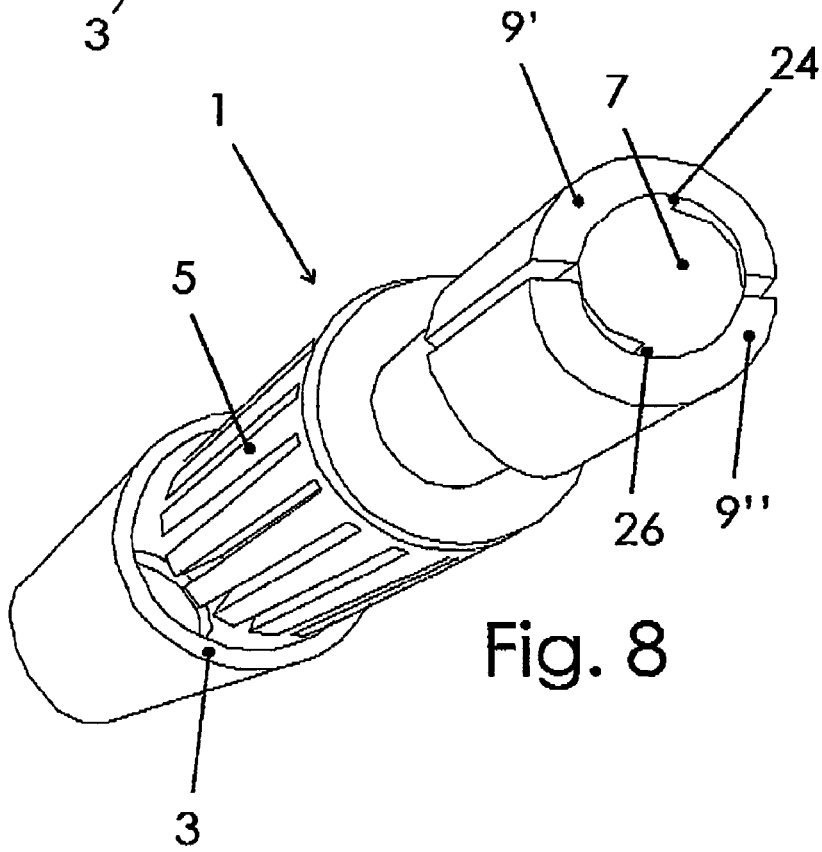
FIG. 8 is a partial side perspective view of the device shown in FIG. 1 that shows the jaws in their retracted position.

As can be seen particularly in FIGS. 7 and 8, the eccentric brake controller 7 comprises a cylindrical member having two spiral-shaped external surfaces 24, 26 that, when rotating along the first rotation direction, enlarge the eccentric brake 9 against the drum 10, as can best be seen in FIG. 8, but when rotating along the second rotation direction, operating on braking ramp "heels," reverse the enlargement as can best be seen in FIG. 7 thereby allowing the free rotation of the eccentric brake 9 inside the drum 10. It is important that the expansion gradient of the braking mechanism 1 is lower than the coefficient of friction of the materials which comprise the braking mechanism 1, so that the brake 9 is not forced into a rotation without performing a correct braking action.

As can be seen particularly in FIGS. 2, 4, and 6-8, the eccentric brake 9 comprises two or more than two jaws 9', 9" that comprise two half-cylinders with variable wall thicknesses. The jaws 9', 9" are adapted to fill the space between the eccentric brake controller 7 and the drum 10. It is important that the jaws 9', 9" be constructed of appropriate thicknesses since an excessive clearance of the jaws if their thickness is too small would compromise the locking of the jaws 9', 9", while even a minor excess thickness would prevent correct free rotation of the jaws.

Figure 6:
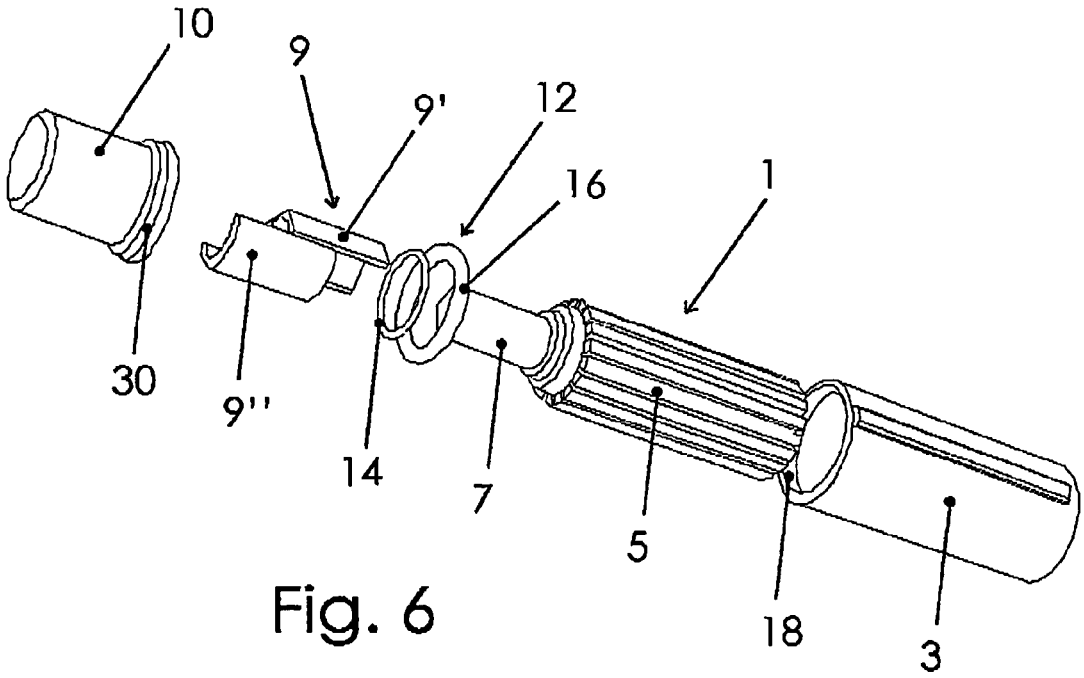
FIG. 6 is a close-up, exploded, side perspective view of the braking mechanism shown in FIG. 1.

As can be seen particularly in FIG. 6, the braking mechanism 1 further comprises one or more than one holder 12 for viscous fluid that are operatively inserted on one side between the rotor 5 and the housing 3, and on the other side between the rotor 5 and the drum 10 to prevent the viscous fluid from leaking out of the braking mechanism 1. In one embodiment, the holder 12 comprises two or more than two gaskets, such as for example O-rings, lip seals or labyrinth seals 14, 16, though other types of holders are also possible, as will be appreciated by one of ordinary skill in the art with reference to this disclosure. One gasket 14 is placed at an interface between housing 3 and rotor 5, and the other gasket 16 is placed at an interface between rotor 5 and drum 10. The gasket 16 prevents the leakage of fluid from contacting the jaws 9', 9" and, thereby, reducing their efficiency. The gasket 16 is not, however, essential to the braking mechanism 1. As will be appreciated by one of ordinary skill in the art with reference to this disclosure, for a monodirectional braking mechanism of the ratchet gear type, the gasket 16 would serve no function.

Figure 5:
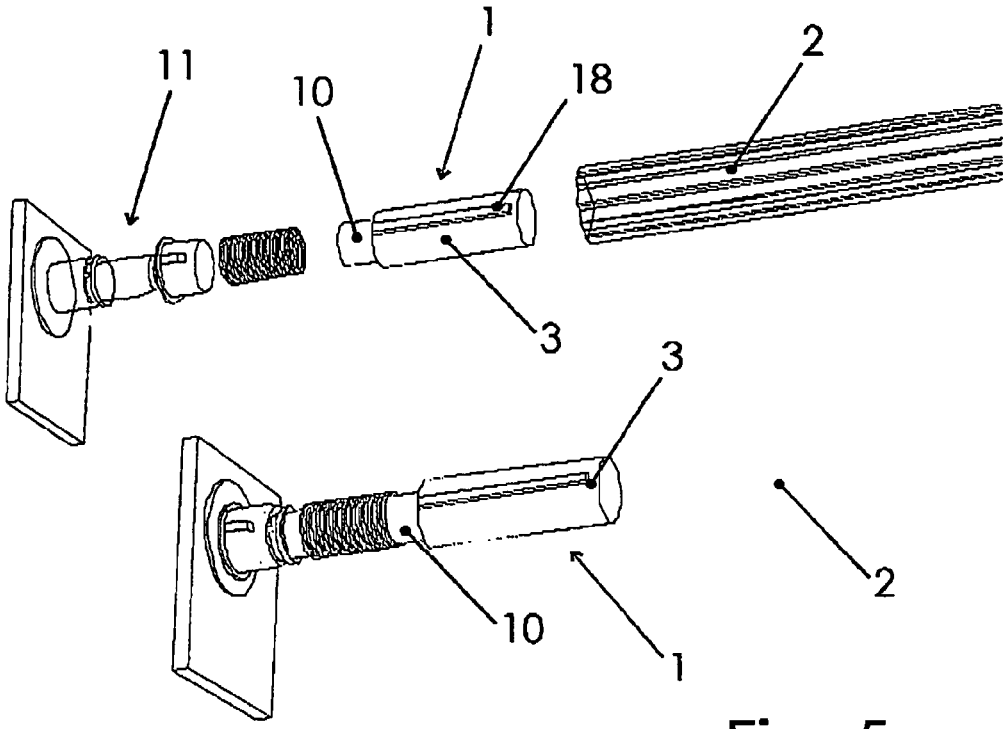
FIG. 5 is an exploded, side perspective view (upper) of the braking mechanism shown in FIG. 1 about to be inserted into one end of a roller, and a side perspective, partial cutaway view of a device according to one embodiment of the present invention (lower) comprising a braking mechanism as shown in FIG. 1.

In a preferred embodiment, the housing 3 comprises one or more than one clamp 18, such as for example a key-type clamp as shown in the Figures adapted to engage the roller 2 as can be seen in FIG. 5 to operatively connect the roller 2 to the braking mechanism 1. The clamp 18 prevents rotation between the roller 2 and braking mechanism 1. In one embodiment, the drum 10 is also equipped with a clamp for the same purpose.

The viscous fluid inside the braking mechanism 1 can be any suitable fluid, as will be appreciated by one of ordinary skill in the art with reference to this disclosure. In a preferred embodiment, the viscous fluid comprises an oil. In one embodiment, the viscous fluid comprises high-viscosity oil, for example 100,000 cSt oil. In another embodiment, the viscous fluid comprises a grease such as used in some viscous-dynamic brakes in order to make it easier to manufacture the sealing members.

By way of example only, a braking mechanism 1 according to the present invention resists a swinging torsion stress of at least about 0.2 Nm and dissipates a power of about 5 mechanical W during a typical rewinding of about 0.3 m/s, with a braking force of about 15 N. The braking mechanism 1 does not generate excessive heat, either during a single action comprising a braking distance of about 2 m or during repeated actions at its maximum rate.

As will be appreciated by one of ordinary skill in the art with reference to this disclosure, the braking mechanism of the present invention can be used for many applications in many fields. The basic principle of the present invention is that the inventive device comprises a kinematic chain comprising a fluido-dynamic braking system and a fluido-dynamic brake. The fluido-dynamic braking system comprises a moving part, adapted to transmit force torques with a rightward or leftward movement, depending on whether the device is rotating in a first direction or in an opposite second direction. The fluido-dynamic brake in turn is made of one or a plurality of viscous friction stages, each one of these stages being in turn composed of a stator in this general case and a rotor.

In one embodiment, the braking mechanism 1 of the invention further comprises a rate multiplier as will be appreciated by one of ordinary skill in the art with reference to this disclosure, such as for example an epicyclic type rate multiplier, placed at the rotor 5 inlet and adapted to increase the rotor 5 rate to obtain a greater braking torque or to permit the use of a lower viscosity oil and make manufacturing of the braking mechanism easier. The rate multiplier helps the braking torque increase with an increase in the rate of rotation of the rotor, since the rotor rate is greater than the housing rate by an amount that is equal to the reduction ratio. In the particular case of an epicyclic reduction gear, moreover, a reversal of the rotor rotation direction is realized, so that the relative rotor-housing rate will be equal to:

$$\Delta\omega=\omega\ r+\omega s*R$$

where $\Delta\omega$ is the angular rotor-housing rate, $\omega r$ is the angular rotor rate and $\omega s$ is the angular housing rate. Therefore, as will be appreciated by one of ordinary skill in the art with reference to this disclosure, the use of a rate multiplier is particularly desirable where high braking moments have to be obtained in a small space.

As will be appreciated by one of ordinary skill in the art with reference to this disclosure, even though the preferred embodiment of the braking mechanism is of the fluido-dynamic type, other embodiments are also an important feature of the present invention so long as the braking mechanism has a braking torque that is intrinsically dependent on the rate ω inverse, in order to avoid having to manually intervene in order to complete the rewinding of the material. For example, in one embodiment the braking mechanism is based on an eddy currents brake, such as for example a braking mechanism comprising a housing made of a conducting material and a rotor made of a magnetic material, such as for example made of an electromagnetic material that can be externally activated. Alternatively, in another embodiment the braking mechanism is also based on an eddy currents brake, such as for example a braking mechanism comprising a housing made of a magnetic material, such as for example an electromagnetic material that can be externally activated, and comprising a rotor that is made of a conducting material. In this embodiment, by moving the two parts relative to each other flow variations of the magnetic lines cutting the conducting material are obtained thereby inducing therein some eddy currents (Foucault currents), that in turn create a magnetic field with a direction that opposes the cause that generated it (Lenz law), or the movement itself, thereby causing the desired braking action. Though more costly than the fluido-dynamic braking mechanism, this embodiment allows the braking mechanism to operate at temperatures too low for oil to be used. Moreover, the use of electromagnets avoids the insertion of the monodirectional device that was used to reduce the braking capability when closing the device.

In a preferred embodiment, the monodirectional device is made substantially of plastic materials. Referring now to FIG. 9, there is shown one type of monodirectional device, a ratchet gear type, where the housing 3' is contained inside the rotor 5', and comprises one or more than one elastic catching element 20 adapted to mate with corresponding saw teeth 22 protruding from the internal circumference of the rotor 5' is equipped in order to realize a braking action along a direction and a sliding action along an opposite direction. This embodiment does not require lubricants or the seals to maintain the lubricants in place.

In another embodiment of the present invention, the braking mechanism 1 comprises a helical spring brake. This embodiment causes less noise during operation that the above disclosed embodiment. In this embodiment, the helical spring is wound around a pin or forced into a hole. When the spring is forced to rotate along the same winding direction by an external torque, it loses its grip and lets the pin slide, while when it is forced to rotate in the opposite direction, it is increasingly tightened, thereby blocking the pin itself. In this case, the directions of operation can be easily reversed, replacing a rightward spring with a leftward spring and vice versa. The spring can also function as articulated joint between the rotor and housing.

As will be appreciated by one of ordinary skill in the art with reference to this disclosure, the braking mechanism can be made of any suitable material. In a preferred embodiment, the braking mechanism of the present invention substantially comprises a plastic material, such as for example an acetalic homopolymer, and is manufactured through an injection molding technique this allows cost savings due to scale of production. Plastic construction also allows the parts of the braking mechanism that are subjected to wear to have a more consistent production tolerance and smooth surfaces, which increase the reliability of the braking mechanism.

According to another embodiment of the present invention, there is provided a device for extending and retracting a sheet of material on a roller. In a preferred embodiment, the device comprises a roller 2 and further comprises a braking mechanism designed to reduce the force and rate of rotation of the roller when the sheet of material is retracted around the roller as compared with conventional devices for extending and retracting a sheet of material on a roller. In a preferred embodiment, the device comprises a braking mechanism according to the present invention. In one embodiment, the device further comprises an external system 11 for holding the braking mechanism to a surface or object. In a preferred embodiment, the device comprises a sheet of material attached to the roller 2.

According to another embodiment of the present invention, there is provided a method of extending and retracting a sheet of material on a roller where the force and rate of rotation of the roller are reduced when the sheet of material is retracted around the roller. In a preferred embodiment, the method comprises providing a device according to the present invention having a sheet of material wound around the roller. The method further comprises causing the roller of the device to rotate in a first rotation direction to extend the material attached to the roller, and then causing the roller of the device to rotate in a second rotation direction to retract the material attached to the roller, where the rotation of the roller in the second rotation direction actuates the braking mechanism in the device reducing the rate of rotation of the roller, the force of rotation of the roller or both the rate and force of rotation of the roller, as the roller rotates in the second direction, and where the second rotation direction is the reverse of the first rotation direction.

Although the present invention has been discussed in considerable detail with reference to certain preferred embodiments, other embodiments are possible. Therefore, the scope of the appended claims should not be limited to the description of preferred embodiments contained in this disclosure. All references cited herein are incorporated by reference to their entirety.

What is claimed is:

1. A monodirectional braking mechanism for use with a device for extending and retracting a sheet of material on a roller, the braking mechanism comprising:

a) one or more than one housing, where the housing is a tubular structure having an inner surface and comprising saw teeth equally spaced around the entire inner surface;

b) one or more than one rotor within the housing;

c) a brake controller connected to the rotor, the brake controller comprising a ratchet gear comprising one or more than one elastic catching element extending from the shaft of the rotor which engages the saw teeth in order to actuate the braking mechanism; and d) a brake operatively coupled with the brake controller;

where each of the saw teeth comprises two sides, a first side and a second side, extending from the inner surface of the housing and intersecting at a point, and where the first side is a different length than the second side;

where the braking mechanism reduces the force or rate, or both the force and rate, of rotation of the roller as the roller is rotated in a second rotation direction but has substantially no effect on the force or rate of rotation of the roller when the roller is rotated in a first rotation direction; and where the first rotation direction is the reverse of the second rotation direction.

2. The braking mechanism of claim 1, further comprising one or more than one viscous fluid within the housing.

3. The braking mechanism of claim 2, where the viscous fluid comprises one or more than one high-viscosity oil.

4. The braking mechanism of claim 2, where the viscous fluid comprises one or more than one grease.

5. The braking mechanism of claim 1, where the rotor comprises a plurality of wings.

6. The braking mechanism of claim 1, where the brake controller comprises a cylindrical member having two spiral-shaped external surfaces.

7. The braking mechanism of claim 1, where the brake comprises two or more than two jaws.

8. The braking mechanism of claim 1, further comprising one or more than one holder for viscous fluid within the housing.

9. The braking mechanism of claim 8, where the holder comprises two or more than two gaskets.

10. The braking mechanism of claim 1, further comprising a rate multiplier connected to the rotor.

11. A device for extending and retracting a sheet of material comprising:

a) a roller; and b) a braking mechanism according to claim 1.

12. The device of claim 11, further comprising a system for holding the braking mechanism to a surface or object.

13. The device of claim 12, where the braking mechanism further comprises one or more than one drum adapted to be coupled to the system.

14. The device of claim 11, where the housing further comprises one or more than one clamp connecting the roller to the braking mechanism; and where the clamp prevents rotation between the roller and braking mechanism.

15. The device of claim 11, further comprising a sheet of material attached to the roller.

16. A method of extending and retracting a sheet of material on a roller comprising:

a) providing a device according to claim 11, where the device further comprises a sheet of material wound around the roller;

b) causing the roller of the device to rotate in a first rotation direction to extend the material attached to the roller; and c) causing the roller of the device to rotate in a second rotation direction to retract the material attached to the roller;

where the rotation of the roller in the second rotation direction actuates the braking mechanism in the device reducing the rate of rotation of the roller, the force of rotation of the roller, or both the rate and force of rotation of the roller, as the roller rotates in the second direction; and where the first rotation direction is the reverse of the second rotation direction.

* * * * *